US006375601B1

(12) United States Patent
Johnson

(10) Patent No.: US 6,375,601 B1
(45) Date of Patent: Apr. 23, 2002

(54) PHYSICAL TRAINING AND EXERCISE APPARATUS

(76) Inventor: Ronald B. Johnson, 10921 W. Martin Rd., Casa Grande, AZ (US) 85222

( * ) Notice: Subject to any disclaimer, the term of this patent is extended or adjusted under 35 U.S.C. 154(b) by 0 days.

(21) Appl. No.: 09/340,626

(22) Filed: Jun. 28, 1999

Related U.S. Application Data

(60) Provisional application No. 60/116,775, filed on Jan. 22, 1999.

(51) Int. Cl.[7] ..... A63B 26/00

(52) U.S. Cl. ..... 482/142; 482/139; 297/452.13; 5/110

(58) Field of Search ..... 482/142, 121–123, 482/129, 130–132, 906, 907, 139, 15, 27–28, 30–32, 35–37, 78; 297/274, 281, 452.13; 135/95; 5/110–115

(56) References Cited

U.S. PATENT DOCUMENTS 2,930,430 A * 3/1960 Bloom ..... 155/77
4,198,045 A * 4/1980 Millier ..... 272/142
4,638,995 A * 1/1987 Wilson ..... 272/144
4,867,142 A * 9/1989 Jones ..... 128/57
4,927,139 A * 5/1990 Taltre ..... 272/144
5,100,131 A * 3/1992 Frong ..... 482/112
5,795,276 A * 8/1998 Almeda ..... 482/142
5,902,220 A * 5/1999 Lin ..... 482/142
6,063,015 A * 5/2000 Johnston ..... 482/142

* cited by examiner

*Primary Examiner*—Justine R. Yu
(74) *Attorney, Agent, or Firm*—Gregory J. Nelson

(57) ABSTRACT

An exercise apparatus for maintaining a resilient exercise component such as an exercise ball in a position elevated above the floor or support surface. In a preferred embodiment, the body of the apparatus may be a frame or may be a molded structure or may be an inflatable structure having a seat area which receives and supports the ball. The support may be provided with rungs which provide gripping locations to assist the user while exercising. The body or frame is configured to allow the user to assume an exercise position closely adjacent the seat which supports the exercise component. A wide range of stretching, conditioning, and therapeutic exercises may be performed using the apparatus.

8 Claims, 5 Drawing Sheets

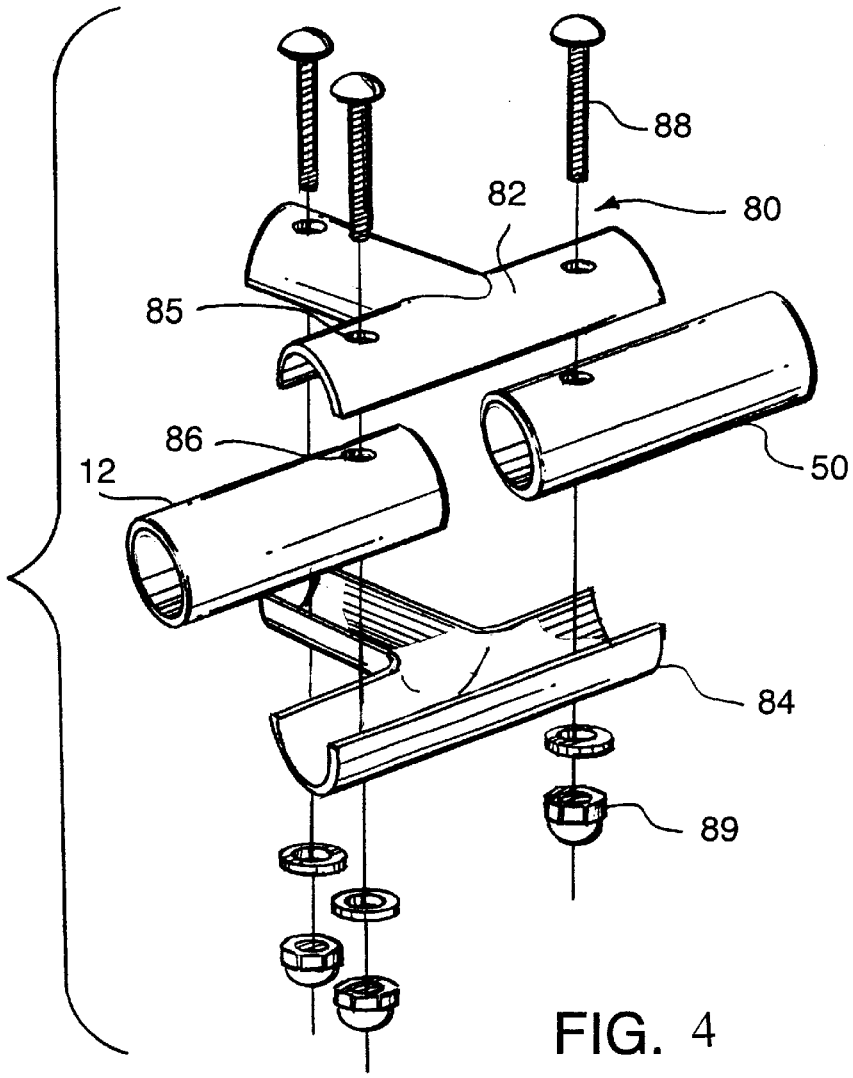
FIG. 4
FIG. 5
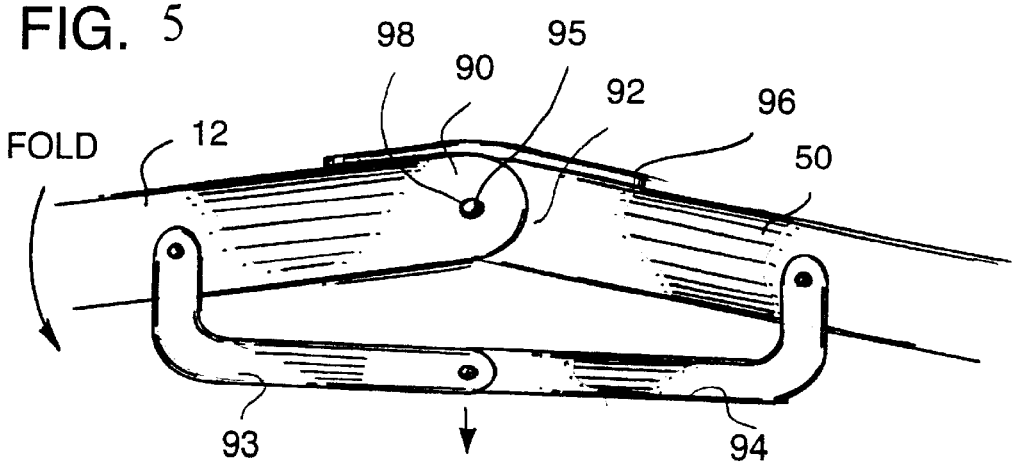

Reverse Hyperextension

Lumbar Traction

Back Extension

Abdominal Crunch

PHYSICAL TRAINING AND EXERCISE APPARATUS

This application claims the benefit of U.S. Provisional Application No. 60/116,775 Jan. 22, 1999.

CROSS REFERENCE TO RELATED APPLICATION

This application is based on provisional patent application Ser. No. 60/116,775, filed Jan. 21, 1999 entitled "Physical Training Apparatus".

FIELD OF THE INVENTION

The present invention relates to physical training and fitness equipment and more particularly relates to an exercise apparatus for stretching, exercise and therapy which apparatus has a seat supported above the floor to supportingly receive a resilient exercise ball thereby increasing the stability and exercise options for the individual when using a resilient exercise ball.

BACKGROUND OF THE INVENTION

Various types of resilient exercise devices for increasing flexibility, strength and therapy are available. One such device is the exercise ball. Exercise balls are often used for physical conditioning and therapy in the sports, physical fitness and orthopaedic fields. Exercise balls, sometimes called "therapy balls" or "Swiss balls", are flexible balls generally ranging in diameter from approximately 30 cm to 85 cm. and may be inflatable or may be filled with a soft foam material to provide the necessary flexibility. Balls of this type are used for a wide range of exercise activities including spinal exercises, exercises for cardiovascular improvement and activities to strengthen the upper and lower extremities. Further, because of the wide range of low impact exercises that can be performed using such balls, balls of this type are also well suited for use by higher risk individuals.

Various types of therapeutic or exercise balls are available. The basic exercise ball, as indicated above, is a flexible, inflatable or foam filled ball of rubber or plastic and is available in various diameters. The balls are generally round but may be somewhat elongated or cylindrical in shape for various exercises and for use by the higher risk patient. For convenience, the term "exercise ball" will be used herein to denote balls of this type of various sizes and shapes.

The following prior art patents relate to exercise balls:

U.S. Pat. No. 5,735,776 describes an isometric exercise device in the form of an inflatable exercise ball, about 18" in diameter which is fitted with a pair of looped handles secured diametrically to opposite points on the ball through which the arms or legs of the user can be placed in order to perform specialized exercises using the ball in a tension mode. The ball is only partially inflated so as to provide a soft, compliant accommodation and can be utilized in conjunction with various body parts. The handles are attached to the main ball by sonic welding.

U.S. Pat. No. 5,810,700 describes an exercise apparatus which is a resilient ball with a flexible strap assembly and a resistance member coupled to the resilient ball via the flexible strap assembly. The resilient ball is configured so that a user may rest a portion of his or her body on the resilient ball while pulling the resistance member in an elongation direction. The strap assembly includes first and second straps adapted to surround and couple to the resilient ball. A loop formed at one of the straps receives the resistance member.

U.S. Pat. No. 4,735,776 also relates to an inflatable exercise ball fitted with looped handles which may be used to perform various isometric exercises.

U.S. Pat. No. 4,833,587 discloses an exercise apparatus having a base with a concave recess in its top surface adapted to receive a resilient ball and at least one attachment point for removably attaching an elastic band. The elastic band has a handhold attached to its end that can be grasped by a user to perform a desired exercise regime.

While balls provide the individual with a wide range of conditioning and therapeutic exercise options, exercise balls have the disadvantage that because of their generally spherical shape they are not always stable. Stabilizing the ball increases the range of exercise options available to the user and also increases safety particularly when used by higher risk users such as pregnant women or individuals undergoing therapy for rehabilitation of an injury or a medical condition.

Generally, exercise balls are used in an exercise area on a floor surface without a base. In some instances, a base such as shown in U.S. Pat. No. 4,833,587 may be used and prior art exercise ball bases are generally simple, disk-like members with a convexity to receive a portion of the ball. The disadvantage of such devices is that they do not support the ball in an elevated position above the floor and further provide only a limited degree of increased stability for the ball as more vigorous use of the ball may cause the ball to roll or slip from the base. The prior art devices do not allow the person exercising to position himself or herself closely adjacent the ball and do not provide hand grips to assist in certain exercises.

Accordingly, there exists a need for a physical training exercise device that may be used to support a resilient exercise ball in an elevated position to enhance and expand the exercise options and benefits available when using such a ball.

BRIEF SUMMARY OF THE INVENTION

Briefly, in a preferred embodiment the present invention provides an exercise apparatus for use in conjunction with an exercise component such as an exercise ball. The exercise apparatus has a frame having an intermediate seat section with opposed side rails which are supported in an elevated position above the floor by opposite pairs of legs. Cross members extend transversely between the opposite pairs of legs at the opposite edges of the seat area. One pair of legs supports a plurality of transversely extending rung members which may be engaged by the hands and legs of the user. The frame may be constructed from tubular aluminum or steel or other material having suitable strength for the intended purpose. The frame may be appropriately painted or powder coated. The terminal ends of the legs are provided with caps or feet to provide good frictional engagement with the supporting surface. Similarly, the rungs may be provided with resilient grips or pads for convenience and the comfort of the user.

The intermediate seat is preferably a strong, flexible fabric material such as nylon or canvas which extends between the transversely extending cross rails at the opposite edges of the seat. The seat will receive one or more exercise balls and supports the balls in a stable, elevated position above the floor surface permitting the user a wide range of exercise options.

The frame may be a rigid, one-piece frame or the frame components may be connected to the seat portion of the frame by either removable clamp connectors or hinges which allow the frame to be either folded to a compact position or removed for convenience of transportation and storage.

In yet another embodiment of the invention the apparatus has a unitary body with a generally planar base with end walls and side walls which define a trough-like seat member at an intermediate location above the base. The member may be molded from plastic or may be an inflatable member fabricated from a heavy rubber or polymeric material. One end wall is preferably fitted with a plurality of spaced-apart, transversely extending handles which can be utilized by the individual when performing various exercises.

BRIEF DESCRIPTION OF THE DRAWINGS

The above and other objects and advantages of the present invention will become more apparent from the following description, claims and drawings in which:

FIG. 4 is a detail view showing one type of clamp connection which may be utilized to secure the various frame components of the apparatus;

FIG. 5 is a detail view of an alternate pivotal frame connection;

DETAILED DESCRIPTION OF THE DRAWINGS

Figure 1:
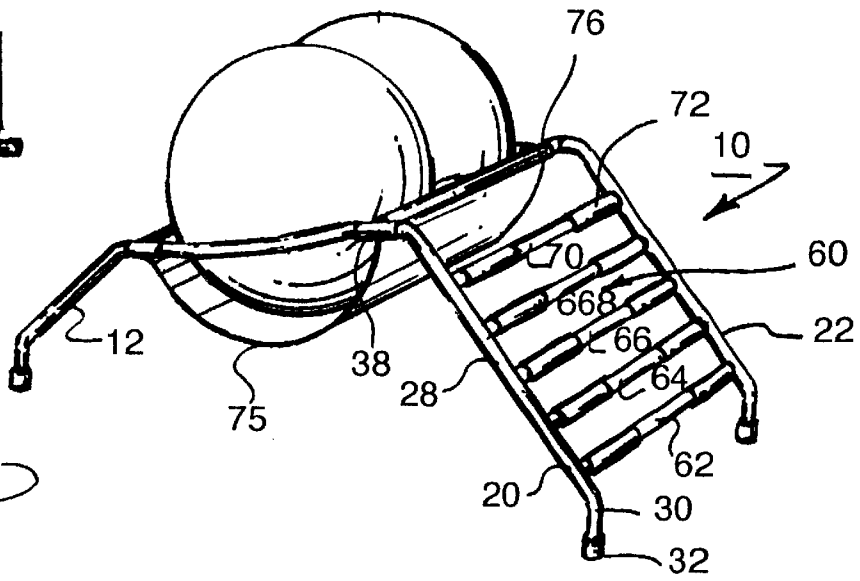
FIG. 1 is a perspective view of the exercise system of the present invention with an exercise ball shown in an exercise position in the seat portion of the apparatus.
Figure 2:
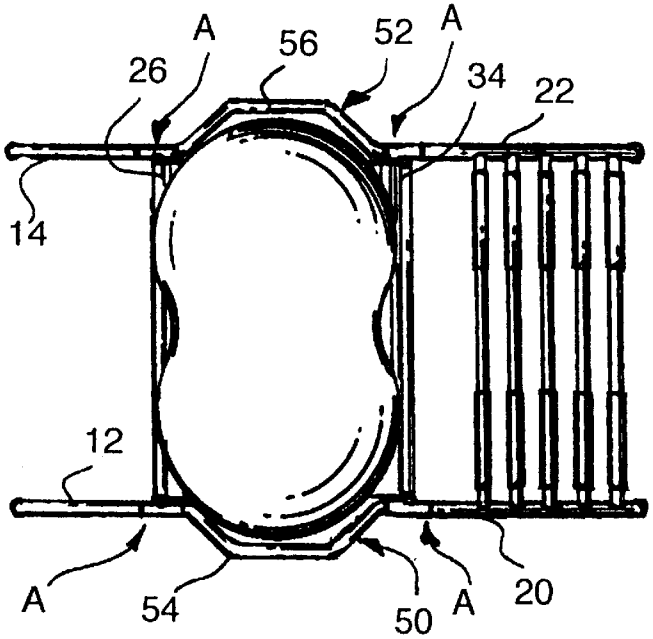
FIG. 2 is a top view thereof.
Figure 3:
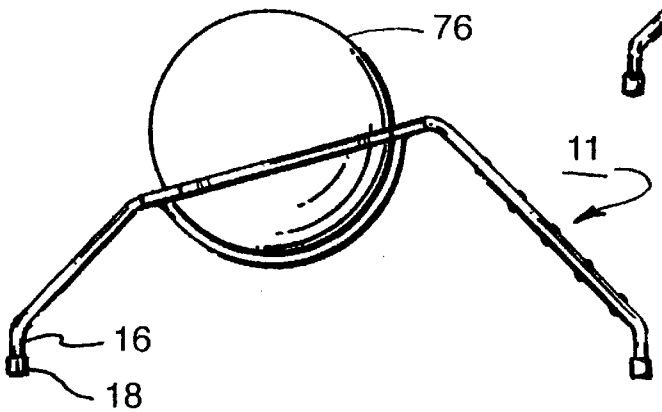
FIG. 3 is a side view thereof.

Turning now to the drawings, particularly FIGS. 1 through 3, the exercise apparatus of the present invention is generally designated by the numeral 10 and has a frame 11 which includes a first pair of legs 12 and 14 which are spaced apart typically approximately 27". The legs 12 and 14 are similar and each extend angularly downward and terminate at a lower vertical section 16. The distal end of lower leg section 16 is provided with a foot or cup 18 which may be rubber or similar material which will provide frictional adherence to the floor surface and will also prevent damage to the floor surface. A cross member 26 extends between the upper ends of legs 12 and 14. It is noted that no frame member or obstruction extends between the legs 12 and 14 below cross member 26.

A second pair of legs 20 and 22 are spaced apart and positioned opposite legs 12 and 14. Legs 20 and 22 each have a downwardly inclined portion 28 which extends to a vertical distal portion 30. Again the vertical portions 30 are each provided with an end cap 32.

The inclined portion 28 of the legs 20, 22 extend at an angle with respect to the floor of approximately 45°. The upper ends of legs 20, 22 are bent to form a downwardly extending angular section 38. The downwardly extending angular sections 38 are interconnected by a cross member 34 at an elevation of approximately 20" above the floor. The parallel cross members 26 and 34 are spaced apart a distance of approximately 21".

Side rail 50 connects the legs 12 and 20. Similarly, side rail 52 connects the upper end of leg 14 and leg 28. The cross members 26 and 34, along with the side rails 50, 52 form a seat section. It will be noted that the side rails 50, 52 extend angularly downward connecting at the upper ends of legs 12 and 14, respectively. Preferably, the side rails 50, 52 also are bowed outwardly at intermediate sections 54 and 56.

A ladder section 60 is provided between legs 20, 22. The ladder section 60 is associated only with legs 20, 22 and the area between legs 12 and 14 is unobstructed so the user can assume a position between legs 12 and 14 adjacent the exercise component supported on the seat 75 as will be explained below. The section 60 comprises a plurality of rungs 62, 64, 66, 68 and 70 which extend transversely between legs 20, 22 and are parallel to one another and spaced apart about 6". The lower-most rung 62 extends between the legs immediately above vertical sections 30 of the legs. The frame 11 consisting of the legs, rungs, side members and cross members may be fabricated from a suitable material such as tubular steel or aluminum and joined by conventional fabrication and joining techniques such as welding or by swaging the components together. The frame assembly preferably is painted or coated with a coating such as a powder coating for durability and improved appearance.

The rungs are shown as each having spaced-apart pad members 72. The pad members 72 may be a rubber or polymeric foam sleeve which preferably extend entirely across the rungs and are adhesively secured to the rungs. The pad may serve as grips to provide a comfortable engagement surface for the user and also will assist to absorb moisture and perspiration and resist slipping when the apparatus is in use. The pads, particularly the pad covering the uppermost rung 70, also serve to cushion the back of the head of the user when performing exercises in a supine position such as a back extension.

A seat is defined by flexible sling 75 which extends between the cross members 26 and 34 and occupies substantially the entire area between the sides 50, 52. The sling is preferably a fabric material such as a strong nylon or canvas fabric and in a use position is suspended from the cross rails 26 and 34 forming the generally concave seat 76. The cross members 26 and 34 may extend through sleeves formed by stitching at opposite edges of the fabric sling 75 or the sling may be secured to the sleeves by use of fasteners such as snaps or hook and loop type fasteners. In the latter case, the sling may be more easily removed for cleaning or replacement.

The apparatus shown in FIGS. 1 to 3 is an integral or one-piece assembly. For some applications the user may prefer an assembly which may be disassembled or collapsed for convenience of transportation and storage. Accordingly, referring to FIG. 4, clamp connectors 80 may be utilized at the locations on the frame indicated by the circles and designated by the letter A in FIG. 1. At these locations, approximately where the cross member intersect the legs, the cross members 26 and 34, legs 12, 14, 20 and 22 and side rails 50, 52 may be separate components. The legs 20, 22 are preferably a single section including transversely extending rungs which rungs would be permanently secured to the legs 20, 22 by welding or other conventional joining techniques.

The clamp connectors 80 each comprise a tee-shaped pair of halves 82, 84 which define a general semi-circular surface shaped to conform to the shape of the frame members. The tee-sections can be applied to join the frame members and preferably each have through bores 85 which align with bores 86 in the associated frame member such as member 12 and 50 which are representative. The halves or sections of the clamp connections are applied at the locations indicated by the letter A and secured in place by fasteners such as bolts 88 which extend through the sections and through the aligned bores in the frame and are secured by fasteners such as cap nuts 89 to minimize any sharp edges which may present a hazard to the user. To disassemble the unit for storage it is a relatively easy matter to remove the cap nuts 89 and remove the fasteners 88 and clamp sections 84, 85 at each of the four locations "A" shown in FIG. 1. The unit can then be conveniently disassembled into its components consisting of the front legs, 20, 22, and transverse rungs which are unitary, cross rails 26, 34, side sections 50, 52, and legs 12, 14. These components can be conveniently stored along with the clamp connectors and may be easily reassembled for use.

Figure 4A:
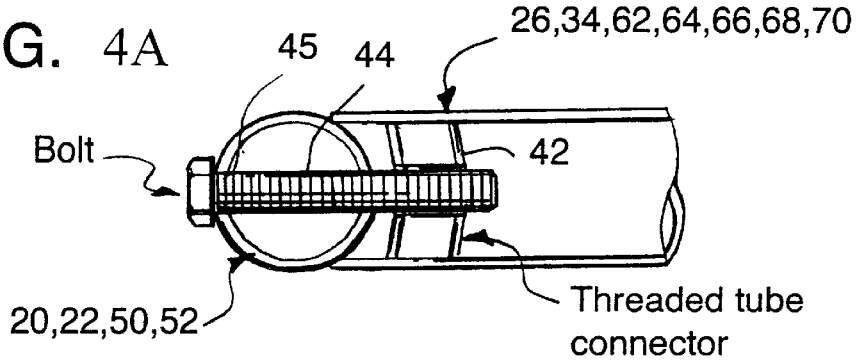
FIG. 4A is a detail view showing an alternate frame construction detail.

In FIG. 4A another frame connection is shown which connection may be utilized, for example, at locations A, as seen in FIG. 1. In FIG. 4A, tubular frame members such as sections 20, 22, 50, 52 may be bolted into adjoining sections such as sections 26, 34, 62, 64, 66, 68 and 70, respectively. An internally threaded tube connector 42 is secured inwardly of the end of a tube section and receives a bolt 44 which extends through aligned bores 45 so that cross members may be easily connected or disconnected.

Figure 4B:
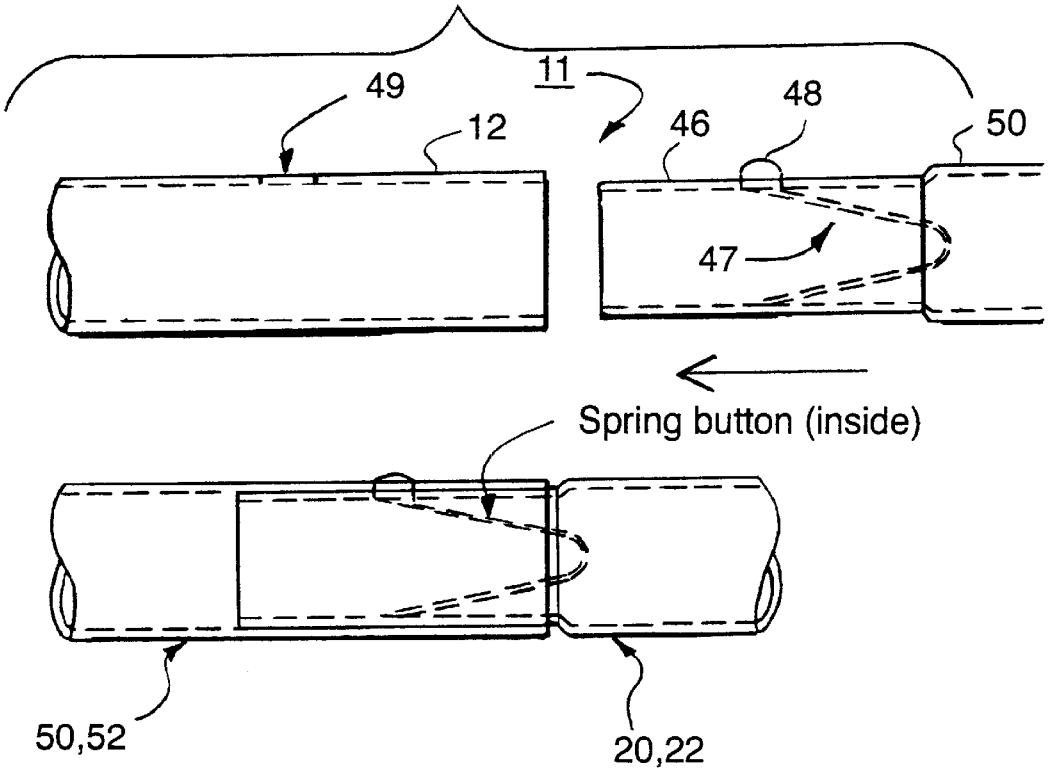
FIG. 4B shows yet another alternate frame construction detail.

In FIG. 4B, the adjoining ends of sections of frame 11, as for example section 12 and 50, are formed so that the ends are swaged with one section 46 having a reduced diameter so as to be received in the hollow interior of adjacent section 12. A spring detent 47 has a button 48 which will in the fully inserted and assembled position will engage bore 49 to detachably secure the sections 12 and 50 together.

FIG. 5 shows an alternate construction in which the legs 12, 14, 20 and 22 are pivotally connected to the ends of the side sections 50, 52 at approximately the same locations as indicated by the letter "A" in FIG. 1. For example, leg 12 and the associated end of the side 50 would preferably be formed into cooperating flattened sections 90, 92 each having a rounded end. Bores 95 would be provided in each of the ends, which bores can be brought into alignment with the rounded ends overlapping. A stop 96 in the form of a projection is associated with the upper surface of leg 12. Pivot links 93, 94 extend between the adjacent frame member and may be locked to secure the frame member in an unfolded position. A fastener such as a bolt 98 having a wing nut 99 extends through the aligned holes 95 and may be manually tightened once the joint connection between the sides and the legs is assembled. Loosening the connection with allow the legs to fold inwardly and upwardly, generally adjacent the sides 50, 52. In the assembled position, the normal exercise routines will result in downward force being applied to the support which will be resisted by the stop 96.

Figure 6:
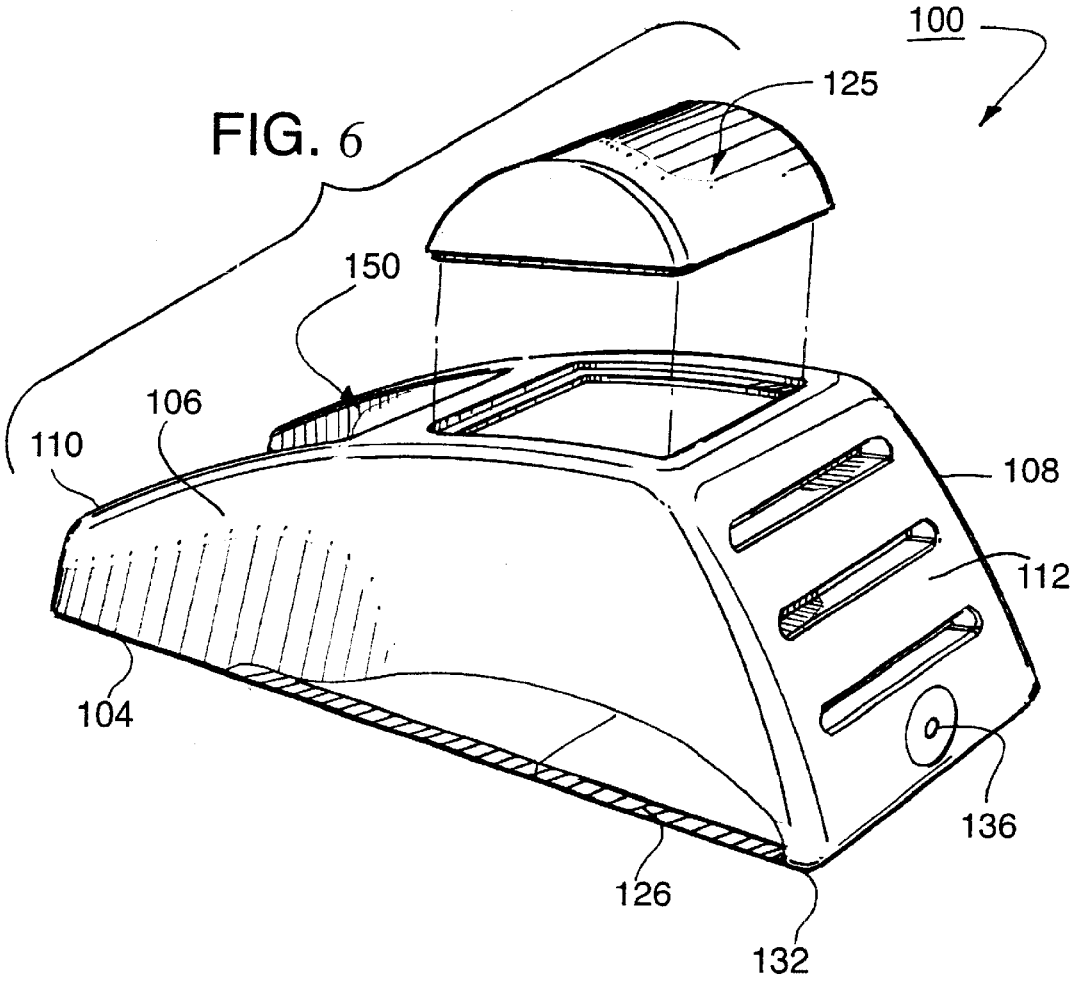
FIG. 6 is a perspective view of an alternate embodiment of the apparatus of the present invention.

FIG. 6 shows an alternate embodiment of the apparatus of the present invention which embodiment is generally designated by the numeral 100. The apparatus 100 includes a generally planar base 104 and a body including side walls 106, 108 and end walls 110, 112. End wall 110 inclines upwardly to one edge of a transversely extending seat 125 integrally formed in the body which is formed to receive the exercise ball component. Wall 112 inclines upwardly to the opposite transverse edge of the seat and is preferably of a vertical dimension greater than wall 110 so that the seat 125 is somewhat inclined. The base, side walls, end walls and seat are integrally formed from a flexible material such as a heavy gauge polymeric material or rubber which is inflatable by introducing air into the interior of the body or a bladder within the interior through valve 136 as is conventional. Alternatively, the body may be molded from a suitable resilient material such as high density polyethylene or nylon. An access opening 150 extends between walls 106 and 108 in wall 110 so the user may position himself or herself near the seat 125. The planar base 104 may be reinforced and weighted by a member such as panel 126 of wood or plastic secured to the base or inserted into a pocket 132 formed between several plies of the base material.

The various embodiments of the present invention provide the user convenience, stability and a wide range of exercise options. A principal advantage of the exercise apparatus is that it will serve to support exercise components of various shapes and sizes in an elevated position above the floor surface at a convenient height for a wide variety of exercises. This greatly enhances the versatility of the apparatus, particularly with higher risk users as the exercise ball is maintained in the trough or saddle and will not easily slip or roll away as it may when used on a floor surface or on a disk or plate-like base. The apparatus provides a broad base support with the base or legs extending oppositely a substantial distance from the ball. The frame preferably has rungs or grips on one side for gripping or engagement with the user's hands or feet. The frame is preferably open in the area, for example between legs 12 and 14 in FIGS. 1 to 3, to allow the user to assume a position immediately adjacent the ball supported in the seat area.

FIGS. 7 to 10 illustrate representative exercises that may be performed using an exercise ball "B" shown in connection with the apparatus 10. While the apparatus 10 of the embodiment shown in FIGS. 1 to 3 is represented in these figures, the alternate embodiments as represented by FIGS. 4, 5 and 6 may also be used in a similar manner. The exercise device 10 is placed on an exercise surface such as floor "F" and the ball "B" is positioned within the seat 75. The ball "B" may be of various sizes and types and may be spherical or may be an elongated, somewhat cylindrical exercise ball. The ball "B" when in use is flexible and inflated or partially inflated to provide a curved surface which is resilient and compliant.

Figure 7:
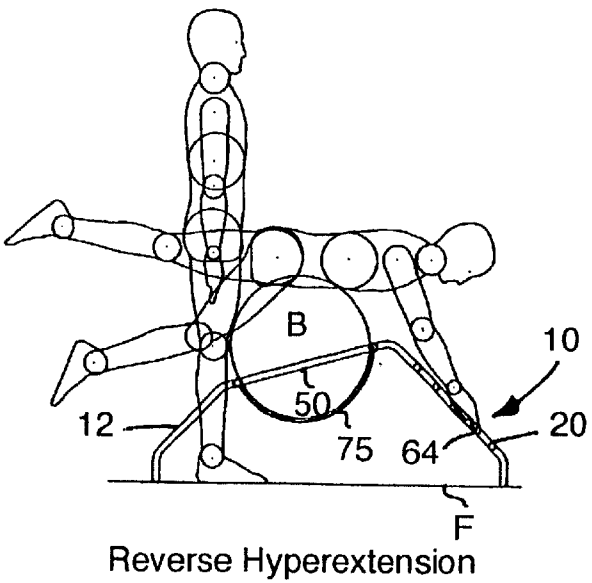
FIGS. 7 to 10 illustrate representative exercises that may be performed using the apparatus of the present invention with an exercise ball.

In FIG. 7 the individual is shown performing a reverse hyper extension in which the user begins by standing in a vertical position adjacent the elevated exercise ball "B". Note the construction of the frame allows the user to stand within the confines of the frame between legs 12 and 14 close to the ball "B". The individual then leans forward to a generally horizontal position with the abdominal portion of the user's body centered over the ball. The user can move forward to a position in which the user can easily grasp one of the rungs of the ladder section at the convenient grips such as rung 64 provided thereon. The ball "B" is maintained at an elevated position with the center of the ball at approximately the level of the knees so that this exercise may be comfortably performed and the ball stabilized so that it will not roll laterally or transversely.

Figure 8:
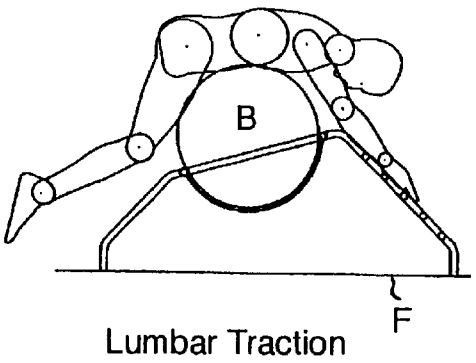

Similarly, in FIG. 8 the user is shown performing a lumbar traction exercise in which the user has placed his or her abdominal region over the ball "B" while grasping rung 66 of the ladder section of the device. Since the ball is again supported in an elevated position above the exercise surface "F", the exercise may be comfortably and effectively performed without placing unnecessary stress on the lumbar or other areas of the spine.

Figure 9:
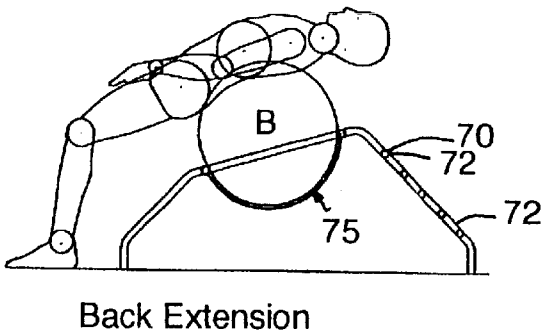

A back extension exercise is shown in FIG. 9 which is facilitated by the elevated position of the ball "B" allowing the user in a supine position to bend rearwardly engaging the upper lumbar spine portion with the ball surface. The convenient support of the ball in the elevated position within the seat 75 prevents the ball from slipping or rolling in either an axial or transverse direction. With some users, the back of the head may extend to the rung 70 and the pad 72 will cushion the head.

Figure 10:
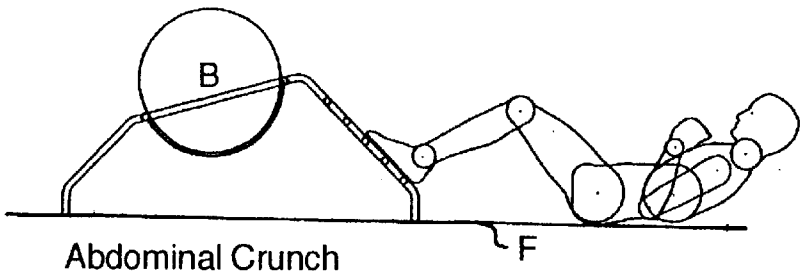

The apparatus of the present invention can be used for other exercises that do not utilize the exercise ball "B". A representative exercise of this type is shown in FIG. 10 in which the user has positioned himself or herself in a supine position on the floor adjacent the apparatus. The device is placed at the bottom of the user's feet on the lower rungs 62, 64 and 66 of the ladder section elevating the feet and providing resistance to movement as the user lifts the user's head and shoulders from the floor surface. Proper performance of the abdominal "crunch" involves only raising the shoulders the above the floor about 6" with the arms in a tucked position so that undue stress is not placed on the spine, particularly the lumbar region.

While the exercise apparatus of the invention has been described above with particular reference to the use of a separate exercise ball, the apparatus may be used with an exercise component or pad other than a ball which component may be detachable or may be an integral part of the support system.

It will be seen from the above that the exercise apparatus of the present invention provides a versatility and may be used in connection with exercise balls of different size and shapes to provide a wide range of available exercise options for improving strength and flexibility to various parts of the body.

It will be obvious to those skilled in the art to make various changes, alterations and modifications to the invention described herein. To the extent that such changes, alterations and modifications do not depart from the spirit and scope of the appended claims, they are intended to be encompassed therein.

I claim:

1. An exercise apparatus to allow the user to perform a variety of exercise routines using an exercise ball with the ball supported on the apparatus, said apparatus comprising:

(a) a frame having;
  (i) first and second spaced-apart legs each having a lower end and extending upwardly and angularly to an upper end;
  (ii) a first cross member extending transversely between said first and second legs;
  (iii) third and fourth legs spaced from said first and second legs each extending upwardly and angularly to an elevation higher than the upper ends of said first and second legs;
  (iv) a second cross member extending between said third and fourth legs;

(b) first and second side rail members extending upwardly between said first and third legs and said second and fourth legs, respectively, with said side rail members and said cross members defining a seat area, said side rail members each having an intermediate section which extends outwardly;

(c) a flexible sling supported from said cross members to support and stabilize an exercise ball on the sling and laterally restrained by said side members; and (d) a plurality of generally parallel rungs extending transversely between said third and fourth legs which the user may engage when performing exercises.

2. The exercise apparatus of claim 1 wherein said legs include feet for providing frictional engagement with the floor.

3. The exercise apparatus of claim 1 wherein said rungs are covered by resilient pad.

4. The exercise apparatus of claim 1 wherein said legs are pivotally attached to their respective side members whereby said frame may be collapsed to a compact position.

5. The exercise apparatus of claim 1 wherein said first and second legs are secured to said side members by detachable clamps.

6. The exercise apparatus of claim 1 wherein said seat is inclined with respect to the surface when in use.

7. The exercise apparatus of claim 1 wherein said legs and cross members are tubular members.

8. The exercise apparatus of claim 7 wherein said tubular members are attached by removable connectors.

* * * * *